US011260267B2

(12) United States Patent
D'Amico

(10) Patent No.: US 11,260,267 B2
(45) Date of Patent: Mar. 1, 2022

(54) WEIGHTED-SQUAT EXERCISE MACHINE AND BELT

(71) Applicant: Joseph G. D'Amico, Williamsville, NY (US)

(72) Inventor: Joseph G. D'Amico, Williamsville, NY (US)

( * ) Notice: Subject to any disclaimer, the term of this patent is extended or adjusted under 35 U.S.C. 154(b) by 83 days.

(21) Appl. No.: 15/406,871

(22) Filed: Jan. 16, 2017

(65) Prior Publication Data

US 2017/0203149 A1 Jul. 20, 2017

Related U.S. Application Data

(60) Provisional application No. 62/279,709, filed on Jan. 16, 2016.

(51) Int. Cl.

| | |
|---|---|
| ***A63B 23/04*** | (2006.01) |
| ***A63B 21/06*** | (2006.01) |
| ***A63B 21/00*** | (2006.01) |
| *A63B 71/00* | (2006.01) |
| *A63B 71/02* | (2006.01) |

(52) U.S. Cl.

CPC ..... *A63B 23/0405* (2013.01); *A63B 21/0615* (2013.01); *A63B 21/4009* (2015.10); *A63B 2023/0411* (2013.01); *A63B 2071/0072* (2013.01); *A63B 2071/027* (2013.01)

(58) Field of Classification Search

CPC ..... A63B 23/0405; A63B 21/0615; A63B 21/4009; A63B 2071/0072; A63B 2071/027; A63B 2023/0411

See application file for complete search history.

(56) References Cited

U.S. PATENT DOCUMENTS

| | | | | |
|---|---|---|---|---|
| 3,751,031 A * | 8/1973 | Yamauchi | A63B 21/065 | 273/DIG. 19 |
| 4,357,010 A * | 11/1982 | Telle | A63B 21/00072 | 482/113 |
| 4,674,160 A * | 6/1987 | Gibson | A63B 21/06 | 482/139 |
| 4,872,670 A * | 10/1989 | Nichols | A63B 21/0615 | 482/135 |
| 5,044,632 A * | 9/1991 | Jones | A63B 23/12 | 482/138 |
| 5,554,084 A * | 9/1996 | Jones | A63B 21/0615 | 482/134 |

(Continued)

*Primary Examiner* — Andrew S Lo

(74) *Attorney, Agent, or Firm* — Law Offices Of Alozie N. Etufugh, PLLC; Alozie Etufugh, Esq.

(57) ABSTRACT

A weighted-squat exercise machine comprises a pivotable, length-adjustable lever, a weight supported by said lever, a support base, and a hip-belt that connects a user to the machine. Weights are supported by the machine at a safe distance from a user. The weighted-lever has an angle with respect to the horizon with a range of from about 35 degrees to about 45 degrees. When a user wearing the hip-belt connects it to the weighted-lever, the weight's gravitational force is transferred to the user providing for the user to perform weighted squats in a safe manner as the weights are spaced from the user. Thus, athletes can safety exercise without a spotter even if using 1000 pound weights. The belt supports the weight about the athlete's hip structure so that there is no stress on the user's neck and spine and no restriction in breathing.

18 Claims, 5 Drawing Sheets

(56) References Cited

U.S. PATENT DOCUMENTS

| | | | | | |
|---|---|---|---|---|---|
| 5,707,323 | A * | 1/1998 | Simonson | A63B 23/03508 | 482/136 |
| 5,810,701 | A * | 9/1998 | Ellis | A63B 23/12 | 482/136 |
| 6,022,298 | A * | 2/2000 | Svedarsky | A63B 21/0615 | 482/130 |
| 7,448,988 | B2 * | 11/2008 | Taylor | A63B 21/00181 | 482/133 |
| 7,530,936 | B1 * | 5/2009 | Hall | A63B 21/0615 | 482/137 |
| 9,511,258 | B2 * | 12/2016 | Hoole | A63B 23/1236 | |
| 2004/0023761 | A1 * | 2/2004 | Emery | A63B 21/06 | 482/94 |
| 2004/0209752 | A1 * | 10/2004 | Thonn, Jr. | A63B 21/00072 | 482/140 |
| 2005/0148445 | A1 * | 7/2005 | Carle | A63B 21/0615 | 482/97 |
| 2015/0297942 | A1 * | 10/2015 | Tully | A63B 21/16 | 482/94 |
| 2016/0346586 | A1 * | 12/2016 | Pullins | A63B 21/0615 | |

* cited by examiner

WEIGHTED-SQUAT EXERCISE MACHINE AND BELT

CROSS-REFERENCE TO RELATED APPLICATIONS

This is a Non-Provisional Application of Provisional Application No. 62/279,709 filed on Jan. 16, 2016.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention generally relates to exercise machines and more particularly, relates to a squat exercise machine with accompanying hip-belt.

The background information discussed below is presented to better illustrate the novelty and usefulness of the present invention. This background information is not admitted prior art.

Exercise, in general, is one of the most important things people can do to keep their bodies body fit. Additionally, exercise can prevent or reduce the effects of today's sedentary lifestyle. Specific exercises are often employed to work on specific body problems. One of the most useful specific exercises is squats.

Strong legs are crucial for maintaining mobility and balance, which is of vital importance as we age. Squatting can trigger the release of testosterone and human growth hormone that are vital for muscle growth and to improve muscle mass. Thus, it is easy to understand that squats are beneficial for young and old alike. Squats are of vital importance for strength trainers and body builders.

In strength training, as well as for general fitness, the squat is a compound, full body exercise that trains primarily the muscles of the thighs, hips and buttocks, quadriceps (vastus lateralis, vastus medialis, vastus intermedius and rectus femoris), hamstrings, as well as strengthening the bones, ligaments and insertion of the tendons throughout the lower body. Squats are considered a vital exercise for increasing the strength and size of the legs and buttocks, as well as developing core strength. Isometrically, the lower back, the upper back, the abdominals, the trunk muscles, the costal muscles, and the shoulders and arms are all essential to the exercise and thus are trained when squatting with the proper form. The squat is one of the three lifts in the strength sport of powerlifting, together with deadlifts and bench press. High repetition squats can work wonders for building leg muscle, as well as for building muscles of the entire body. Bodybuilders consider squats the best leg training exercise, mainly because they have been shown to work. Squats are one of the single best exercises for stimulating every single muscle fiber in the lower body while working the core muscles.

There are several squat exercise machines on the market ranging from the complicated and expensive to simple and low cost. A power cage is used to reduce risk of injury and eliminate the need for a spotting partner. By putting the bar on a track, the Smith machine reduces the role of hip movement in the squat and in this sense resembles a leg press. Also used are a weight lifting belt that is supposed to support a user's torso; boards that wedge beneath the ankles to improve stability to allow a deeper squat, and weightlifting shoes with wooden wedges built into the sole to achieve the same effect. One example of a squat exercise device that is relatively simple and inexpensive is a weight lifting belt, such as the Super Squatter® Hip-belt offered by IronMind®.

SUMMARY

The present inventive concept describes a device that provides for safer, more effective, and more comfortable weighted squat training. The device will be referred to as a weighted-squat exercise machine. The weighted-squat exercise machine includes a belt to be worn by a user while using the machine. The belt safely transfers the force of the weights to be lifted from the user's neck and spine onto the user's hips, eliminating the threat of serious injury that often is present with the use of conventional squatting techniques and machines. The basic structure of the exemplar weighted-squat exercise machine, as described in more detail below, comprises a weight supported by a pivotable, length-adjustable lever that is to be lifted or lowered by a user and a hip-belt that assists in the lifting and lowering of the weighed pivotable, length-adjustable lever. Together the weight, length-adjustable lever assembly and the belt provide for the user to perform weighted, conventional, squatting movements in a unique and safe manner when the belt is in position about a user's waist and connected to the machine, as described in more detail below. The weights supported by the length-adjustable lever assembly are safely supported at about a user's hip height near to, but safely away from, the user's body by a weight carriage, which in turn is supported by the pivotable, length-adjustable lever. From 1 to 1000 pounds of weight is capable of being supported when the machine's frame is constructed from steel. When the machine is not in use, the weights, weight carriage, and length-adjustable lever are maintained in-place by a safety support pin. When in use, the safety support pin is disengaged so that the weights, weight carriage, and length-adjustable lever assembly are maintained in a desired position only by the strength of the user attached to the length-adjustable lever assembly via the hip-belt about his waist/hip area. When this configuration is attained, the user can begin the desired squatting motions until the desired repetitions are achieved. There is no stress on the neck and spine because the belt assures that the weight is supported by the user's hip structure. The use of the belt with the machine also reduces the stress on the user's knees because the upper body is allowed to freely move without obstruction.

The described and claimed device is built on the inventive concept developed by the present Inventor when he recognized the disadvantages of using a weight belt that requires the weights to be lifted to be attached to the front and back of the body of a user. Disadvantages of the use of such a belt include the fact that the user must secure the belt around his or her waist in order to straddle, in a squat-like sitting position, a weighted barbell that must be supported above ground level by a weight rack that must be positioned at the required height for attaching the belt to the weight in order to lift the bar bell weight off of the rack. Then, the belt, that is provided with a front strap hook mechanism and a back strap hook mechanism, must be secured to loops around the weighted bar bell that are provided for this reason. To do this, one must reach behind one's back to attach the back hook to the bar bell before attaching the front strap hook. Attaching the back strap hook procedure must be done solely by feel as there is no way to see behind one's back. At this point, the squatter must stand up and then, remaining straddled over the barbell, he must sidle sideways in order to lift the weighted bar bell from its support to move it away from its support to provide freedom for squatting motions by the user. Performing the squatting motion, even then, is difficult because the weights on each end of the barbell that are positioned in front of and behind the belted athlete while he remains squatting over the barbell must be kept balanced to avoid either the front or back weight from hitting the ground and also from causing the athlete to lose his balance. Because of the length of the straps and the proximity of the weights to the ground, squatting movement is limited—that is, while attempting to perform a deep squat one or both of the weights on the bar bell will hit the floor. This is not only awkward; it can create a safety problem if the weights are not balanced as they could cause the squatter to lose balance. When the exercise is complete, the squatter must then step sideways toward the weight support in order to reposition the bar bell on the support. This motion can be dangerous as it exposes the back to injury. The belt must then be released from the barbell before the squatter may fully disengage from the barbell. Even the release has some elements of danger. Releasing the belt means releasing the front cable and the back cable while the athlete is still squatting over the barbell. Not being able to see behind him put the squatter in a precarious position.

A second method for using a hip-belt is to position the desired weight on the weight supporting end of a suspension pin and then attach the other end of the pin to a front hook mechanism on the belt. This means that the weight is between the squatter's legs limiting the width and, thus, the size of the weights that can be used. Moreover, when squatting, one must take care the weight does not land on the squatter's feet.

Recognizing these problems, the present Inventor, using his inventive concept, generated a set of invention principles to produce a squat exercise machine for use with a hip-belt of his own design to assure that the force of gravity is working to produce a continuous tension on the muscles being worked while alleviating the problems described above.

One example of a weighted-squat exercise machine for performing weighted squats, comprises a pivotable, length-adjustable lever, and a weight. The weight supported by the lever creates a weighted-lever, wherein when the weighted-lever is lifted or lowered by a user wearing a hip-belt connected to said weighted-lever a weighted-squat is performed safely and with maximal effect.

The weighted-squat exercise machine also comprises a support base, with the weighted-lever hingedly connected to and supported by the support base, wherein when a user wearing the hip-belt connects the hip-belt to the weighted-lever, the weight's gravitational force is transferred to the user providing for the user to perform weighted squats in a safe manner.

The weighted-squat exercise machine also comprises a hip-belt assembly comprising a hip-belt, a support-cable having a first end and a second end with an attachment device on each of the first end and the second end of the support-cable. The hip-belt has an attachment device to attach the hip-belt to the attachment device on the first end of the support-cable, whereas the attachment device on the second end of the support-cable is structured for attachment to the weighted-squat exercise machine.

Furthermore, the weighted-lever further comprises two parallel, connected lever-arms spaced apart with each of the lever-arms being positioned on an opposing side of the weighted-squat exercise machine's longitudinal axis. The two lever-arms are securely connected by a connection device attached to each of the two lever-arms at any one set of a plurality of desired positions. The support base further comprises a first base leg and a second base leg, the first base leg being spaced from but below the pivotable, length-adjustable lever along the weighted-squat exercise machine's longitudinal axis. Stabilizing steel platforms are attached to at least one base leg. An extension base leg extends upward in the direction of the distal end of the first base leg to connect the first base leg to the pivotable weight support lever assembly via a hinged connection. The extension base leg consists of a stationary outer tube section and a slidably extendable inner tube section providing for the extension base leg to be length adjusted, as desired. The length of the length adjusted extension base leg controls the angle, with respect to the horizontal, of the length adjustable lever, wherein the angle with respect to the horizontal of the length adjustable lever can range from about 35 degrees to about 45 degrees. The hinged connection is on the outer end of the slidably extendable inner tube section. A weight-supporting carriage is supported by the lever assembly whit at least one weight being supported by the weight-supporting carriage. A pin support arm is attached to and projects upward from the first base leg, the pin support arm having a support pin aperture for supporting a support pin in the aperture. The connection device comprises a pair of attachment devices fixedly secured to each other by an attachment pin for securing one of the lever arms to the other lever arm, wherein the attachment pin is also the attachment mechanism used for attaching the hip-belt to the weighted-squat exercise machine.

BRIEF DESCRIPTION OF THE DRAWINGS

In order that these and other objects, features, and advantages of the present invention may be more fully comprehended and appreciated, the invention will now be described, by way of an exemplar weighted-squat ting exercise machine, as illustrated in appended drawings, wherein like reference characters indicate like parts throughout the several figures. It should be understood that these drawings only depict one preferred embodiment of the present invention and are not therefore to be considered limiting in scope, thus, the invention will be described and explained with additional specificity and detail through the use of the accompanying drawings, in which.

A LIST OF REFERENCE NUMBERS AND THE PARTS TO WHICH THEY REFER

Figure 1:
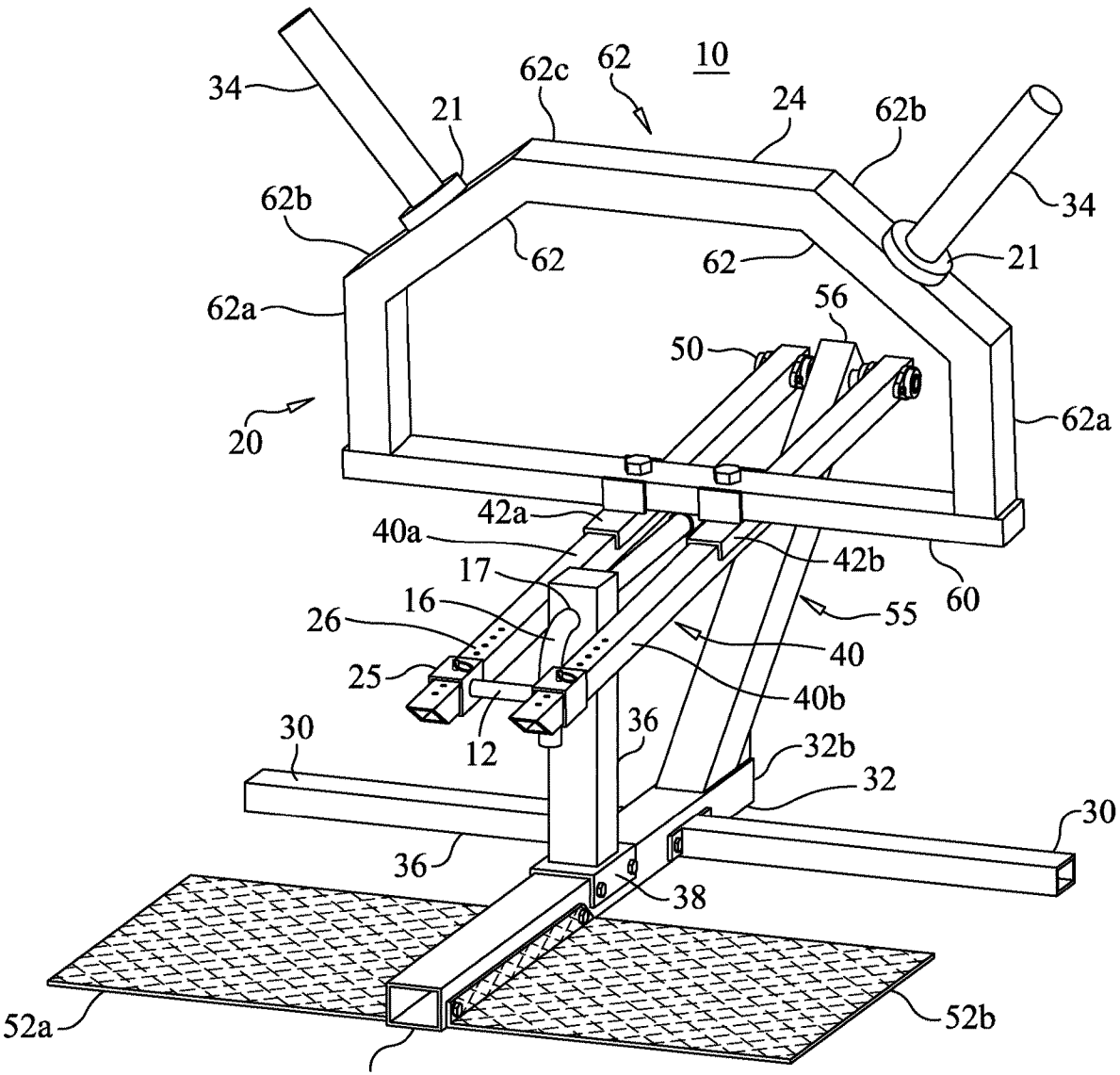
FIG. 1 is a frontal perspective view of one example of a weighted-squat exercise machine according to the inventive concept of the claimed invention.

8 Stopper for securing safety support pin in slot 17.
10 An example of a weighted-squat exercise machine according to the inventive concept of the claimed invention.
12 Attachment pin for attaching hip-belt assembly 100 to machine 10.
16 Safety support pin.
17 Aperture for encompassing safety support pin 16.
20 Weight carriage.
21 Weight peg gasket.
22 Weight.
24 Grasping bar of weight carriage 20.
25 Adjustable attachment devices.
26 Apertures.
30 One base leg.
32 Another base leg.
32*a* One end of base leg 32.
32*b* Another end of base leg 32.
34 Weight holding peg.
36 Arm in which aperture 17 is located.
38 Attachment device.
40 Weight support lever assembly.
40*a* One weight support lever arm 40.
40*b* Another weight support lever arm 40.
42*a* Attachment device.
42*b* Attachment device.
50 Rotatable hinge.
52*a* One stabilizing steel platform.
52*b* Another stabilizing steel platform.
54 Fixed section of extension 55.
55 Angled extension leg connecting base support leg 32 to weight support lever assembly 40.
56 Extendable section of extension 55.
57 Adjustable attachment device.
60 Base of weight carriage 20.
62 Arched top piece of weight carriage 20.
62*a* Vertically-oriented section of arched top piece 62.
62*b* Angled section of arched top piece 62.
62*c* Horizontally-oriented section of arched top piece 62.
100 Hip-belt assembly.
110 Hip-belt.
120 Back support of hip-belt.
122 Attachment link on one end of cable 125.
123 Attachment link on the other end of cable 125.
125 Cable.
200 User.

It should be understood that the drawings are not necessarily to scale. In certain instances, details which are not necessary for an understanding of the present invention or which render other details difficult to perceive may have been omitted.

DEFINITIONS

Lever, as used herein, is a machine consisting of a beam pivotable at a fixed hinge, or pivot, called a fulcrum. A lever is a rigid body capable of rotating on a point on itself.

DETAILED DESCRIPTION

Referring now, with more particularity, to the drawings, it should be noted that the disclosed invention is disposed to embodiments in various sizes, shapes, and forms. Therefore, the embodiments described herein are provided with the understanding that the present disclosure is intended as illustrative and is not intended to limit the invention to the embodiments described herein.

Figure 2:
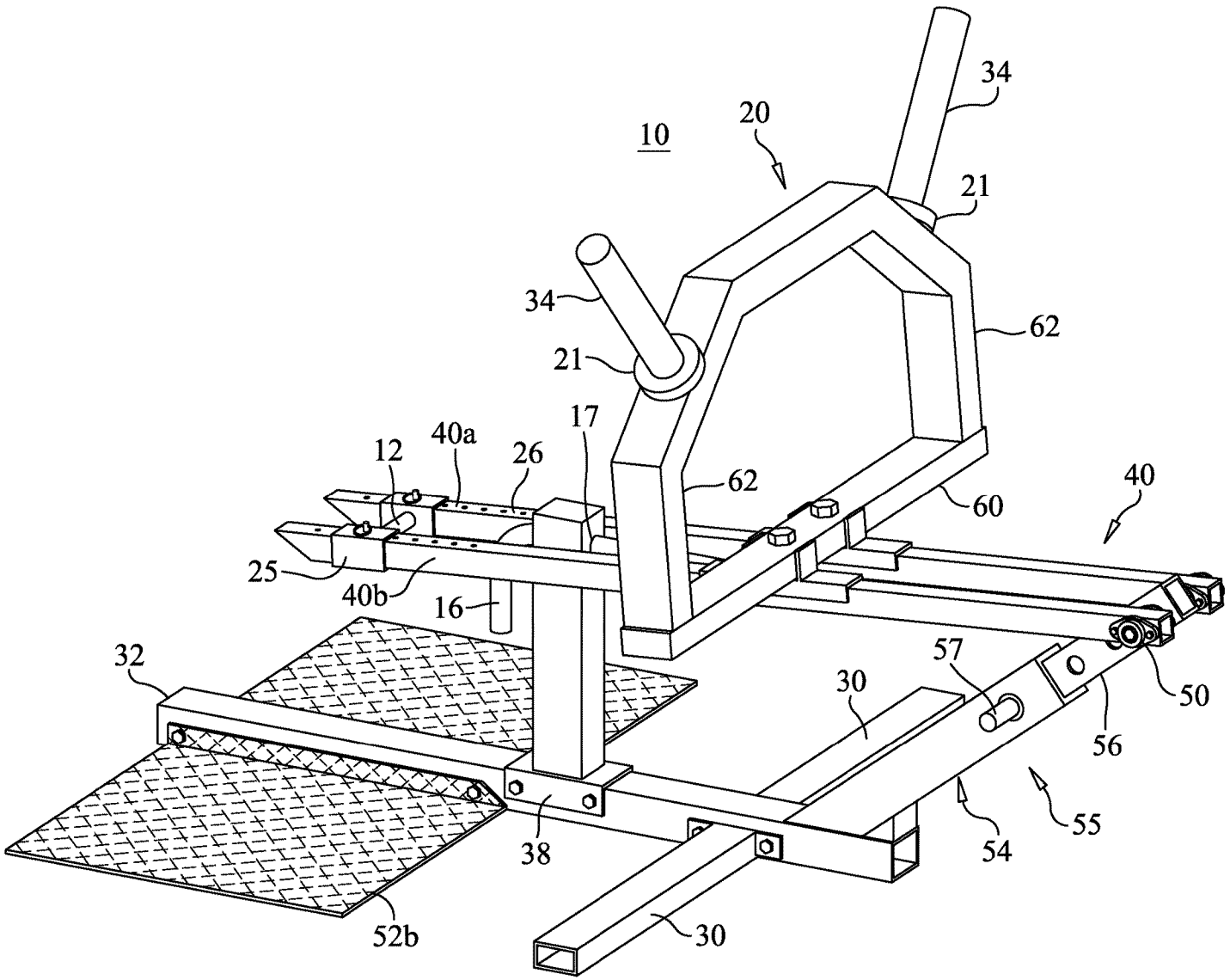
FIG. 2 is a rear side perspective view of the weighted-squat exercise machine, as illustrated in FIG. 1.
Figure 3:
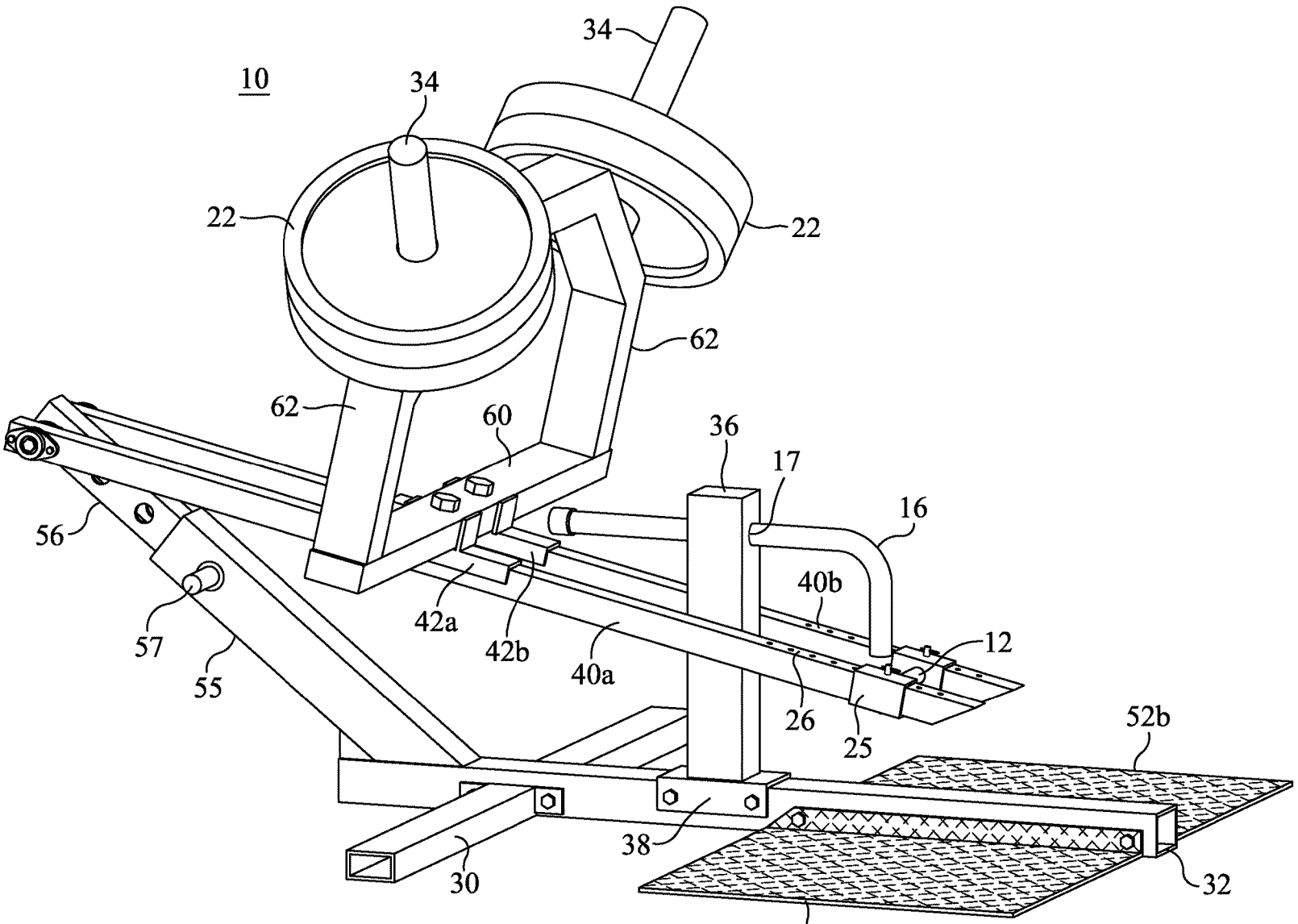
FIG. 3 is a front side perspective view of the weighted-squat exercise machine, as illustrated in FIGS. 1 and 2.

Turning now to the drawings, FIGS. 1-3 to illustrate the structure of an exemplar weighted-squat exercise machine 10 made according to the principles of the inventive concept of the claimed invention. The weighted-squat exercise machine includes weight carriage 20 (also referred to a weight support frame) to support weight(s) 22 at a safe distance from a user's body and at a height from the ground level that provides the positive work-out stress desired. Weight carriage 20, in the example illustrated, comprises a frame formed by weight carriage base 60 having a first and a second end. Connected to the first and second ends of weight carriage base 60 are the first and second ends of arched top piece 62 of weight carriage 20. Arched top piece 62 approximates the shape of an inverted "U". In more detail, arched top piece 62 can be described as having upper horizontally-oriented section 62*c* where each end of horizontally-oriented section 62*c* angling downward to become sections 62*b* that, in turn, become vertically-oriented sections 62*c*. It is the ends of sections 62*c* that are connected to base-arm 60. It is to be understood that the description of weight carriage 20 just provided is for explanatory reasons only and not to be taken as limiting. Weight carriage 20 is contemplated to be structured as required and desired. Weight carriage 20 could be of a single molded construction or be constructed of several individual but connected sections. In this example, horizontally-oriented section 62*c* provides for grasping bar 24. On each of the angled-downward sections 62*b* of arched top piece 62 is weight support peg 34 to hold desired weights 22 (See FIGS. 3 and 4) so that the gravitational force of the weights on the pegs is translated to weight support lever arm assembly assuring a continuous tension on the muscles being worked. Weight support pegs 34, in the example illustrated, are fitted with weight peg gaskets 21 to distribute the mass of weights 22. It should be understood that the two illustrated weight support pegs 34 could alternatively be one support peg or more than two.

The structural elements of weighted-squat exercise machine 10 are supported on its supporting surface, such as a floor surface, by base legs 30 and 32. For the sake of convenience in the following description, the part of the machine where a user connects to the lever assembly shall be referred to as the front of the machine and the part of the machine opposite to the front of the machine shall be referred to as the rear of the machine. The machine illustrated has two base legs, base leg 30 and base leg 32. Base leg 32 is spaced from but in the same plane as pivotable, length-adjustable lever 40. Base leg 30 intersects base leg 32 near to the distal end of base leg forming a right-angled intersection. The end 32*a* of base leg 32 that is situated at the front of the machine has added stabilization provided by the weight of each of the steel platforms 52*a* and 52*b* that are fixedly attached to each side of base support end 32*a*. Near the opposite end of base leg 32, extension 55 angles upwards and outwards away from end 32*b* to connect base leg 32 to pivotable weight support lever assembly 40. Extension 55 includes fixed outer tube section 54 and slidably extendable inner tube section 56. Extendable inner tube section 56 provides for extension 55 to be lengthen as desired depending on the size and weight of the user when squat exercise machine 10 is in use. Several pin receiving apertures are seen in inner tube 56. To set extension 55 to its desired length, retractable pin 57 is set into one of the apertures in tube 56 holding the tubing at the desired length. It should be understood that there are many variations in the structure of support arm 55 that will provide for it to be lengthened and shortened as desired and each of these is contemplated to be within the scope of the invention. Hinge 50 rotatably connects extension 55 to weight support lever arms 40*a* and 40*b* of Weight support lever assembly 40. Pivotable lever arms 40*a* and 40*b* each extend toward the front of the machine from their respective hinge 50. The angle from the horizon of weight support lever assembly 40 is determined by the distance slidably extendable inner tube section 56 is extended, wherein the angle with respect to the horizontal of the length adjustable weight support lever assembly can range from about 35 degrees to about 45 degrees.

Figure 4:
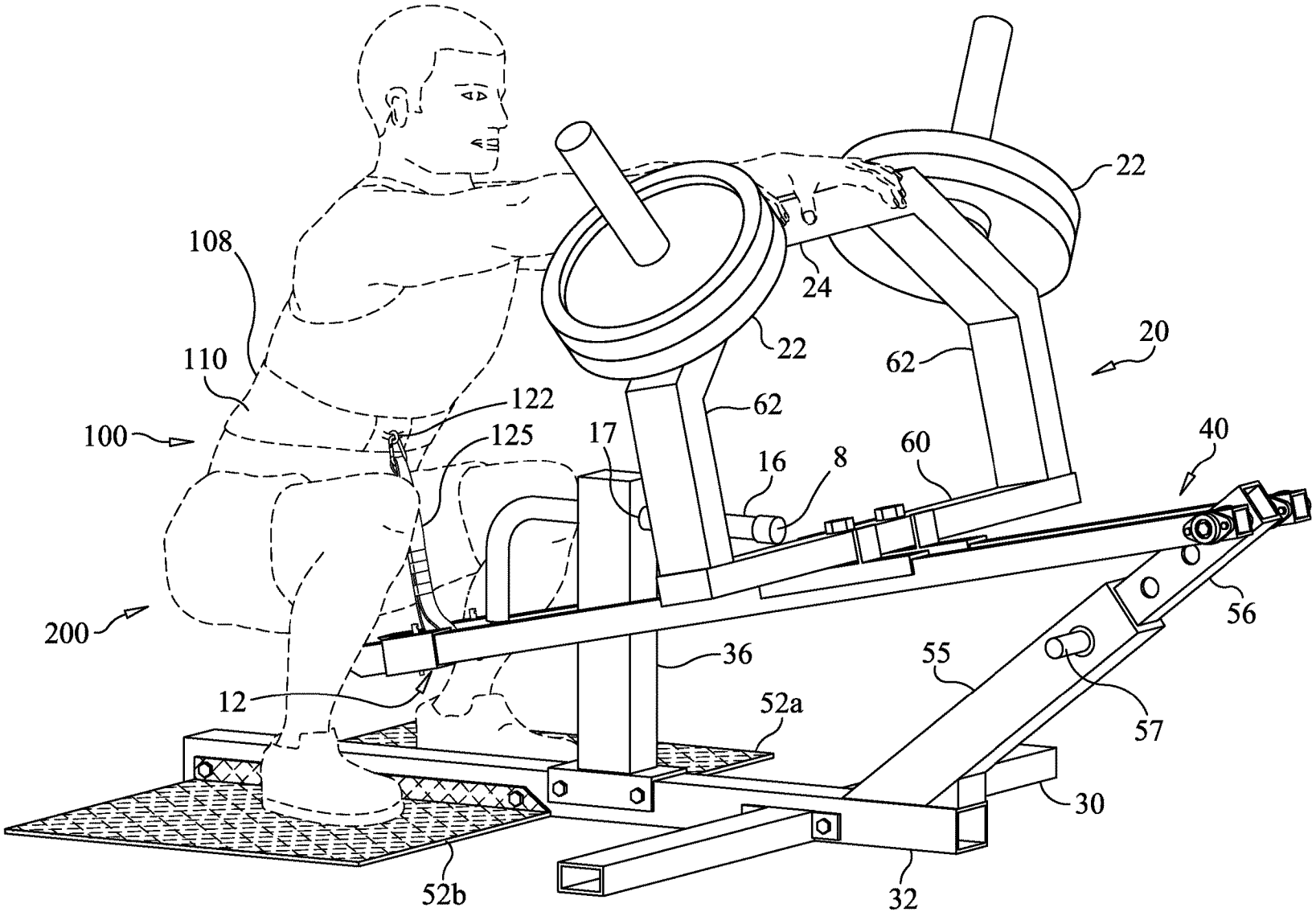
FIG. 4 is a perspective view of the weighted-squat exercise machine, as illustrated in FIGS. 1, 2 and 3, in use.
Figure 5B:
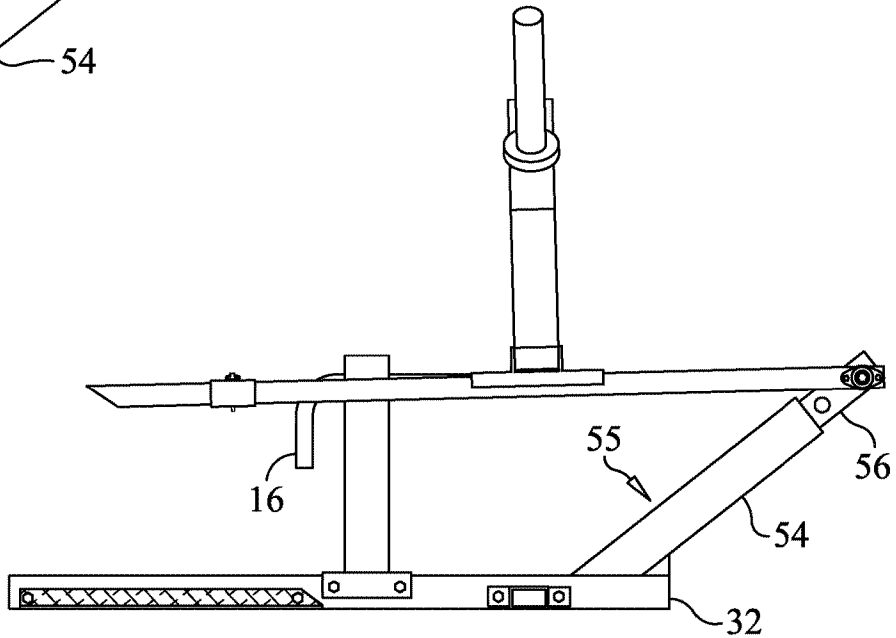
FIG. 5B is an elevation view of weighted-squat exercise machine, as illustrated in the previous figures, with safety support pin engaged.
Figure 5A:
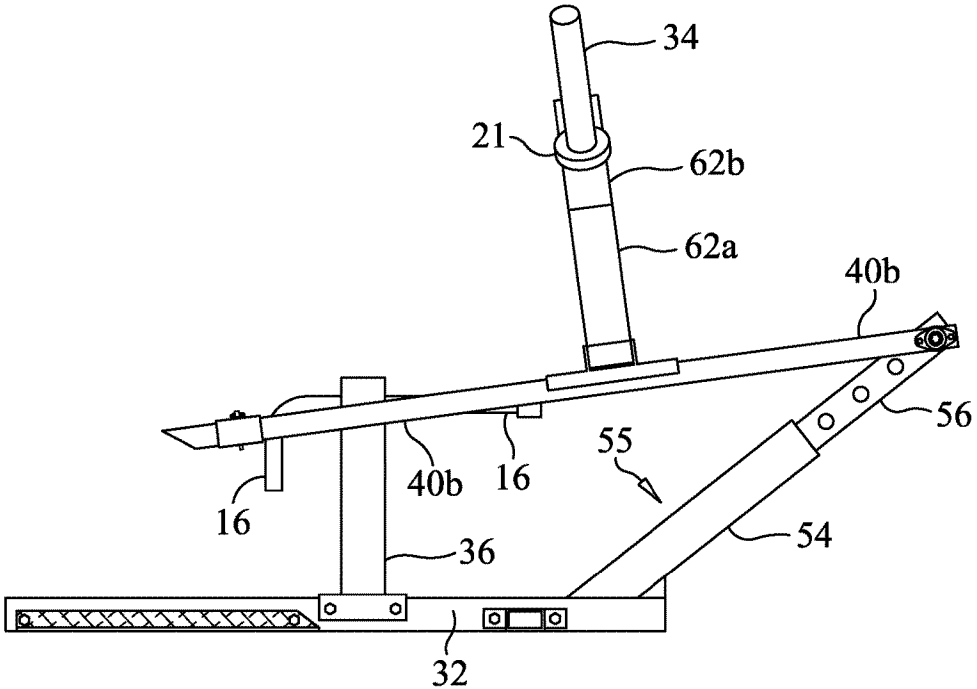
FIG. 5A is an elevation view of the weighted-squat exercise machine, as illustrated in the previous figures, with safety support pin disengaged.

In the illustrated example, proximate to the intersection of base leg 32 and base leg 30, pin support 36 rises vertically from base leg 32 to extend upwards through spaced lever arms 40*a* and 40*b*. Pin support 36 contains aperture 17 therethrough to accept and hold safety support pin 16. When safety support pin 16 is inserted into and through aperture 17 and extends beneath base 60 of weight carriage 20, safety support pin 16 supports base 60. FIG. 5B illustrates safety support pin 16 inserted to its fullest extent through aperture 17 of support arm 36 to support weight carriage 20. FIGS. 3, 4 and 5A illustrate support pin 16 after it has been removed from aperture 17 (i.e., moved in the direction toward a user's body) so that it is no longer supporting weight carriage 20 to allow levers 40*a* and 40*b* the freedom of motion required for a user to perform weighted squats, as illustrated in FIG. 4. When the desired number of squats are completed, the user stands up raising base 60 to reinsert safety pin 16 into slot 17 so that safety pin 16 again supports base 60 with the weight that it is supporting. There is no danger of the user pulling pin 16 out of its slot inadvertently, as safety pin 16 is equipped with stopper 18 for securing pin 16 in slot 17.

Although the amount of weight used with the weighted-squat exercise machine is at the discretion of the athlete, for serious strength building, a fairly heavy set of weights, of up to about 1000 pounds, are generally used, and for this amount of weight the machine should be manufactured of steel. However, if the machine is intended for light weight or young athletes or for beginners who would use considerably less weight, the machine could be made of plastic, fiber glass, or the like.

To use the squat exercise machine, desired weights 22 (See FIGS. 3 and 4) are placed onto each weight peg 14 and hip-belt 110 is attached about a user's waist area. FIG. 4 illustrates one example of a hip-belt assembly being used in conjunction with the claimed invention. Hip-belt assembly 100 comprises belt 110 having attachment means 122 for the attachment of one end of support-cable 125 to belt 110. The other end of support-cable 125 is attached to belt attachment pin 12. Securing the lever arms 40*a* and 40*b* of weight support lever assembly 40 is the device made up of two attachment collars 25 fixedly connected to each other by attachment pin 12. To secure lever arms 40*a* and 40*b* to each other one attachment collar 25 is fitted around lever arm 40*a* while the other attachment collar 25 is fitted around lever arm 40*b*. Devices 25, though slidably attached to lever arms 40*a* and 40*b*, are structured to be fixed in a desired position. The slideable, yet fixable, attachment of devices 25 to lever arms 40*a* and 40*b* provides for attachment pin 12 to be attached to the lever assembly in various distances from the end of the levers, effectively lengthening or shortening the working part of the lever assembly to accommodate the size of the user. In the illustrated example, each of the attachment collars 25 are secured using a pin attachment means. It should be understood that the attachment means can be varied and still be within the principles of the inventive concept. Not shown are additional spaced links on cable 125 that can be used by longer legged athletes. Once a user sets extension 55 to the length desired to adjust the angle of weight support lever assembly 40, sets pin 12 in the desired position to determine the length of weight support lever assembly 40, connects cable 125 at its desired length to his hip-belt and to the machine using attachment device 25 and stands up, the belt machine connection will cause base-arm 60 to rise above safety support pin 16 providing for the user to be able to pull pin 16 toward him so it is no longer under base-arm 60 to allow lever arms 40*a* and 40*b* the freedom of motion required for the user to perform his squats. When the desired number of squats are completed, the user again simply stands up to raise base-arm 60 in order to reinsert safety pin 16 into slot 17 so that safety pin 16 again supports base-arm 60 and weight that rests on it. At this time, the user is free to safely detach his hip-belt from the machine. During the use of the squat exercise machine, back support 120 of belt 110 protects the user's back.

In the claimed invention, the position of the weights away from the user provides a safe method for a user to perform squats using weights that could pose problems if not used in this manner. Athletes can safety exercise alone without requiring a spotter because of the design of the machine. Spotters are typically used to help the athletes complete a repetition when it may be dangerous for the athlete to complete the repetition alone. However, if the athlete fails to complete a repetition, all that he needs to do is to sit on the floor and detach from the attachment pin when using the claimed invention. No spotter needed to assist. Gravity holds the weights securely on the floor out of reach of the athlete. As mentioned above, when using the claimed machine the weight is supported by the athlete's hip structure so that there is no stress on the user's neck and spine. This design also allows no restriction in breathing while doing the exercise. This is important because if the weight is supported by the upper body, which happens when squatting with a barbell or many currently used machines, athlete's diaphragms are constricted making it difficult to them to breathe normally. Restricted breathing prevents the athlete from training the muscle group to the point where maximum results could be achieved if breathing were unrestricted, specifically size and strength. The athlete fails in his training because of restricted breathing, not muscle failure. When using the claimed exercise machine, the athlete's lower body is worked maximally during the entire movement as compared to other machines where the muscles work maximally against gravity during only a small portion of the lift. To the best of the Inventor's knowledge, the claimed squat weight exercise machine is the only machine that has the ability to adjust the height, length, and angle of lever assembly 40, the length and height of extension 55, as well as the length of the attachment chain of belt 125 combined with the adjustable attachment of belt 125 to lever arms 40*a* and 40*b*.

The foregoing description, for purposes of explanation, uses specific and defined nomenclature to provide a thorough understanding of the invention. However, it will be apparent to one skilled in the art that the specific details are not required in order to practice the invention. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention is not limited to the described methods, embodiments, features or combinations of features but include all the variation, methods, modifications, and combinations of features within the scope of the appended claims. The invention is limited only by the claims.

What is claimed is:

1. A weighted-squat exercise machine for performing weighted squats, comprising:

a pivotable weight support lever assembly, connected to a length-adjustable extension, wherein said weight support lever assembly comprises of two parallel, connected lever-arms spaced apart;

a hip-belt assembly, comprising of a hip-belt, wherein said hip-belt assembly is connected to said weight support lever assembly;

a weight, wherein said weight is supported by said weight support lever assembly, wherein a weighted-squat is performed when said weight support lever assembly is lifted or lowered by a user wearing said hip-belt connected to said weight support lever assembly; and a support base, wherein said support base is connected to said length-adjustable extension, said weight support lever assembly being hingedly connected to said length-adjustable extension.

2. The weighted-squat exercise machine, as recited in claim 1, wherein said hip-belt assembly comprises of:

a support-cable having a first end and a second end; and an attachment link on each of said first end and said second end of said support-cable, wherein said hip-belt, by way of an attachment device of said hip-belt, attaches to said attachment link on said first end of said support-cable, wherein said attachment link on said second end of said support-cable is structured for attachment to said weighted-squat exercise machine.

3. The weighted-squat exercise machine, as recited in claim 1, wherein each of said lever-arms is positioned on an opposing side of said weighted-squat exercise machine's longitudinal axis.

4. The weighted-squat exercise machine, as recited in claim 3, wherein said two lever-arms are securely connected by a connection device attached to each of said two lever-arms at any one set of a plurality of desired positions.

5. The weighted-squat exercise machine, as recited in claim 4, wherein said support base further comprises a first base leg and a second base leg, said first base leg being spaced from but below said pivotable weight support lever assembly along said weighted-squat exercise machine's longitudinal axis.

6. The weighted-squat exercise machine, as recited in claim 5, wherein stabilizing steel platforms are attached to at least one base leg.

7. The weighted-squat exercise machine, as recited in claim 6, wherein said length-adjustable extension comprises an extension base leg extending upward from a distal end of said first base leg.

8. The weighted-squat exercise machine, as recited in claim 7, wherein said extension base leg comprises a stationary outer tube section and a slidably extendable inner tube section providing for said extension base leg to be length adjusted as desired.

9. The weighted-squat exercise machine, as recited in claim 8, wherein the length of said length adjusted extension base leg controls an angle with respect to a horizontal axis of the weight support lever assembly.

10. The weighted-squat exercise machine, as recited in claim 9, wherein said angle with respect to the horizontal axis of the weight support lever assembly can range from about 35 degrees to about 45 degrees.

11. The weighted-squat exercise machine, as recited in claim 10, wherein a hinge connection is on an outer end of said slidably extendable inner tube section.

12. The weighted-squat exercise machine, as recited in claim 11, further comprising a weight-supporting carriage supported by said weight support lever assembly wherein at least one weight is supported by said weight-supporting carriage.

13. The weighted-squat exercise machine, as recited in claim 12, further comprising a pin support arm attached to and projecting upward from said first base leg, said pin support arm having a support pin aperture for holding a support pin.

14. The weighted-squat exercise machine, as recited in claim 13, further comprising said support pin in said aperture.

15. The weighted-squat exercise machine, as recited in claim 13, further comprising a connection device including a pair of attachment collars fixedly secured to each other by an attachment pin for securing one of said lever arms to the other of said lever arms.

16. The weighted-squat exercise machine, as recited in claim 14, wherein said attachment pin is configured for attaching said hip-belt to said weighted-squat exercise machine.

17. A weighted-squat exercise machine for performing weighted squats, comprising:

a pivotable, weight support lever assembly connected to a length-adjustable extension, wherein said weight support lever assembly comprises of two parallel, connected lever-arms spaced apart;

a weight, wherein said weight is supported by said, weight support lever assembly;

a support base; and a hip-belt assembly, wherein said hip-belt assembly comprises of: a hip-belt, a support-cable having a first end and a second end, and an attachment link on each of said first end and said second end of said support-cable, wherein said hip-belt comprises of an attachment device that attaches to said attachment link on said first end of said support-cable, wherein said attachment link on said second end of said support-cable is structured for attachment to said weighted-squat exercise machine, wherein said weight support lever assembly is hingedly connected to said length-adjustable extension and supported by said support base.

18. A weighted-squat exercise machine for performing weighted squats, comprising:

a pivotable, weight support lever assembly connected to a length-adjustable extension, wherein said weight support lever assembly comprises of two parallel, connected lever-arms spaced apart;

a weight, wherein said weight is supported by said weight support lever assembly;

a support base; and a hip-belt assembly, comprising of: a hip-belt, a support-cable having a first end and a second end, and an attachment link on each of said first end and said second end of said support-cable, wherein said hip-belt comprises of an attachment device that attaches to said attachment link on said first end of said support-cable, wherein said attachment link on said second end of said support-cable is structured for attachment to said weighted-squat exercise machine wherein said weight support lever assembly is hingedly connected to said length-adjustable extension and supported by said support base wherein said weight support lever assembly has an angle with respect to a horizontal axis that has a range of from about 35 degrees to about 45 degrees.

* * * * *